US010955176B2

(12) United States Patent
Kasai et al.

(10) Patent No.: US 10,955,176 B2
(45) Date of Patent: Mar. 23, 2021

(54) AIR-CONDITIONING APPARATUS

(71) Applicant: Mitsubishi Electric Corporation, Tokyo (JP)

(72) Inventors: Kohei Kasai, Tokyo (JP); Yohei Kato, Tokyo (JP); Satoru Yanachi, Tokyo (JP); Hiroaki Asanuma, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 76 days.

(21) Appl. No.: 15/774,656

(22) PCT Filed: Jan. 12, 2016

(86) PCT No.: PCT/JP2016/050654
§ 371 (c)(1),
(2) Date: May 9, 2018

(87) PCT Pub. No.: WO2017/122265
PCT Pub. Date: Jul. 20, 2017

(65) Prior Publication Data

US 2018/0335236 A1 Nov. 22, 2018

(51) Int. Cl.
*F25B 47/02* (2006.01)
*F24F 11/89* (2018.01)
(Continued)

(52) U.S. Cl.
CPC ..... *F25B 47/025* (2013.01); *F24F 11/89* (2018.01); *F25B 13/00* (2013.01); *F25B 47/02* (2013.01);
(Continued)

(58) Field of Classification Search
CPC .. F25B 47/025; F25B 49/025; F25B 2600/11; F25B 2700/15; F25B 2700/2103; F25B 2700/2106; F25B 2313/0294
See application file for complete search history.

(56) References Cited

U.S. PATENT DOCUMENTS

2013/0291577 A1* 11/2013 Miyakoshi ..... B60H 1/00392 62/151

FOREIGN PATENT DOCUMENTS

EP 2 012 078 A1 1/2009
JP S5946438 A * 3/1984
(Continued)

OTHER PUBLICATIONS

Sato, Controller for Air Conditioner, Feb. 21, 2003, JP2003050066A, Whole Document (Year: 2003).*
(Continued)

*Primary Examiner* — Larry L Furdge
(74) *Attorney, Agent, or Firm* — Posz Law Group, PLC

(57) ABSTRACT

An air-conditioning apparatus includes a controller configured to control operations of an outdoor fan. The controller has a voltage acquisition unit configured to acquire drive voltages of the outdoor fan at set time intervals while the rotation speed of the outdoor fan is maintained at a reference rotation speed, a determination unit configured to determine whether or not an acquired drive voltage is equal to or greater than a lower limit threshold and less than an upper limit threshold, an extraction unit configured to calculate an evaluation value by extracting a drive voltage determined to be equal to or greater than the lower limit threshold and less than the upper limit threshold, and a defrosting determination unit configured to decide to defrost the outdoor heat exchanger if the calculated evaluation value is equal to or greater than an evaluation threshold.

6 Claims, 5 Drawing Sheets

(51) Int. Cl.
*F25B 13/00* (2006.01)
*F25B 49/02* (2006.01)

(52) U.S. Cl.
CPC .... *F25B 49/025* (2013.01); *F25B 2313/0294* (2013.01); *F25B 2600/11* (2013.01); *F25B 2700/15* (2013.01); *F25B 2700/2103* (2013.01); *F25B 2700/2106* (2013.01)

(56) References Cited

FOREIGN PATENT DOCUMENTS

| | | | | |
|---|---|---|---|---|
| JP | H08334285 | A | * | 12/1996 |
| JP | H10246542 | A | * | 9/1998 |
| JP | 2003-050066 | A | | 2/2003 |
| JP | 2003050066 | A | * | 2/2003 |
| JP | 2004-116796 | A | | 4/2004 |
| JP | 2007-292439 | A | | 11/2007 |

OTHER PUBLICATIONS

Maeda et al., Control Device for Air Conditioner, Sep. 14, 1998, JPH10246542A, Whole Document (Year: 1998).*

Miyagami, Refrigerator, Dec. 17, 1996, JPH08334285A, Whole Document (Year: 1996).*

Mogi et al., Defrosting Operation Control Device for Air Conditioner, Mar. 15, 1984, JPS5946438A, Whole Document (Year: 1984).*

International Search Report of the International Searching Authority dated Apr. 5, 2016 for the corresponding international application No. PCT/JP2016/050654 (and English translation).

* cited by examiner

AIR-CONDITIONING APPARATUS

CROSS REFERENCE TO RELATED APPLICATION

This application is a U.S. national stage application of PCT/JP2016/050654 filed on Jan. 12, 2016, the contents of which are incorporated herein by reference.

TECHNICAL FIELD

The present invention relates to an air-conditioning apparatus that defrosts frost attached to an outdoor heat exchanger.

BACKGROUND ART

Conventionally, an air-conditioning apparatus in which a compressor, a flow switching unit, an outdoor heat exchanger, an expansion unit and an indoor heat exchanger are connected by pipes, the air-conditioning apparatus being provided with an outdoor fan and an indoor fan, is known. In a heating operation, if the pressure saturation temperature of the outdoor heat exchanger, which functions as an evaporator, is equal to or less than the dew-point temperature of outdoor air and is equal to or less than the freezing point of water, frost becomes attached to heat radiation fins of the outdoor heat exchanger. The air-conditioning apparatus suppresses deterioration of heat exchange performance of the outdoor heat exchanger due to such a frost formation phenomenon by performing a defrosting operation to remove the frost attached to the outdoor heat exchanger.

Patent Literature 1 discloses an air-conditioning apparatus that performs a defrosting operation if the drive voltage of the outdoor fan is equal to or greater than a predetermined voltage while the rotation speed of the outdoor fan is maintained constant. When frost is attached to an outdoor heat exchanger, the resistance of air passing through the outdoor heat exchanger increases. Therefore, to maintain the rotation speed of the outdoor fan constant, the drive voltage of the outdoor fan increases. In Patent Literature 1, the formation of frost on the outdoor heat exchanger is determined from an increase in the drive voltage of the outdoor fan. In the determination process in Patent Literature 1, drive voltages of the outdoor fan are detected a predetermined number of times, and a defrosting operation is performed if the average of the drive voltages detected the predetermined number of times is equal to or greater than a predetermined voltage. In this manner, an attempt to reduce the influence of a disturbance such as a gusty wind is made.

CITATION LIST

Patent Literature

Patent Literature 1: Japanese Unexamined Patent Application Publication No. 2003-50066

SUMMARY OF INVENTION

Technical Problem

The air-conditioning apparatus disclosed in Patent Literature 1 determines the necessity of a defrosting operation on the basis of the average of the drive voltages, however, it is still not sufficient to eliminate the influence of a disturbance, such as a gusty wind.

To solve the abovementioned problem, the present invention provides an air-conditioning apparatus that determines the necessity of defrosting after sufficiently eliminating the influence of disturbances.

Solution to Problem

An air-conditioning apparatus according to an embodiment of the present invention includes a refrigerant circuit formed by connecting a compressor, an outdoor heat exchanger, an expansion unit and an indoor heat exchanger by pipes and through which refrigerant flows, an outdoor fan configured to send outdoor air to the outdoor heat exchanger, and a controller configured to control operations of the outdoor fan. The controller has a voltage acquisition unit configured to acquire drive voltages of the outdoor fan at set time intervals while the rotation speed of the outdoor fan is maintained at a reference rotation speed, a determination unit configured to determine whether or not a drive voltage acquired by the voltage acquisition unit is equal to or greater than a lower limit threshold and less than an upper limit threshold, an extraction unit configured to calculate an evaluation value by extracting a drive voltage determined, by the determination unit, to be equal to or greater than the lower limit threshold and less than the upper limit threshold, and a defrosting determination unit configured to decide to defrost the outdoor heat exchanger if the evaluation value calculated by the extraction unit is equal to or greater than an evaluation threshold.

Advantageous Effects of Invention

According to an embodiment of the present invention, if the evaluation value, which is calculated by extracting drive voltages determined by the determination unit to be equal to or greater than the lower limit threshold and less than the upper limit threshold, is equal to or greater than the evaluation threshold, the outdoor heat exchanger is defrosted. That is, the necessity of defrosting is determined after excluding the drive voltages that are less than the lower limit threshold or equal to or greater than the upper limit threshold due to occurrences of a disturbance, for example. Therefore, the necessity of defrosting can be determined after sufficiently eliminating the influence of the disturbance.

DESCRIPTION OF EMBODIMENTS

Embodiment 1

Figure 1:
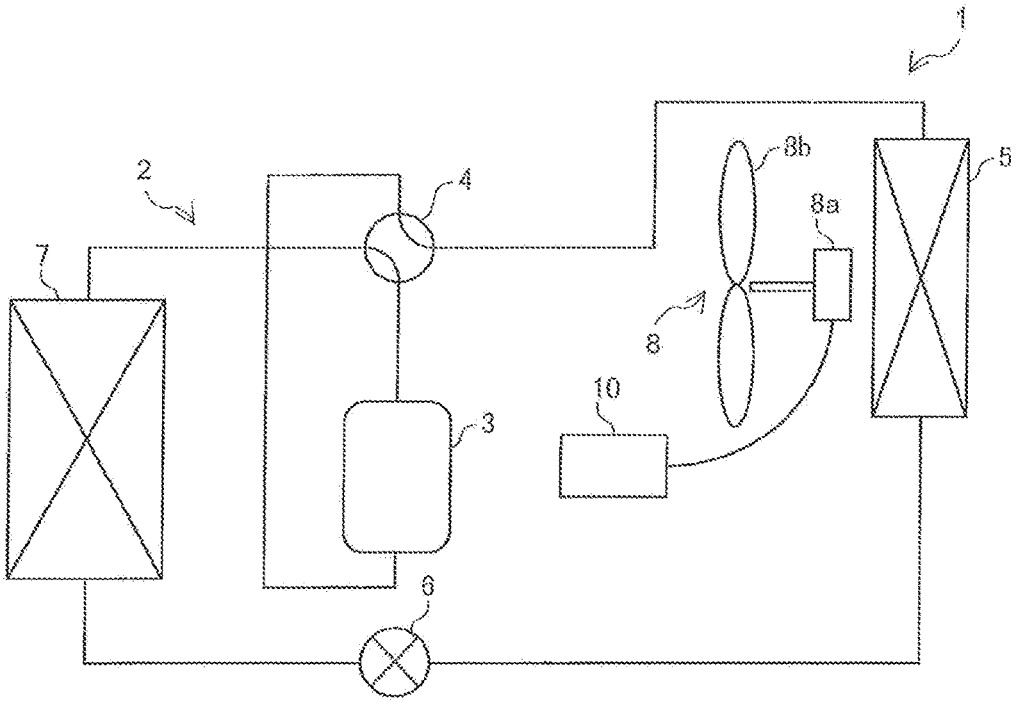
FIG. 1 is a circuit diagram illustrating an air-conditioning apparatus 1 according to Embodiment 1 of the present invention.

An embodiment of the air-conditioning apparatus according to the present invention will be described below with reference to the drawings. FIG. 1 is a circuit diagram illustrating an air-conditioning apparatus 1 according to Embodiment 1 of the present invention. The air-conditioning apparatus 1 is explained on the basis of FIG. 1. As shown in FIG. 1, the air-conditioning apparatus 1 includes a refrigerant circuit 2, an outdoor fan 8, and a controller 10. The refrigerant circuit 2 is formed by connecting a compressor 3, a flow switching unit 4, an outdoor heat exchanger 5, an expansion unit 6, and an indoor heat exchanger 7 by pipes, and allows refrigerant to flow therein.

The compressor 3 compresses refrigerant. The flow switching unit 4 switches the direction of refrigerant flow in the refrigerant circuit 2. The flow switching unit 4 switches whether the refrigerant discharged from the compressor 3 flows into the outdoor heat exchanger 5 or the indoor heat exchanger 7, and thereby one of a cooling operation, a heating operation, or a defrosting operation is performed. The outdoor heat exchanger 5 is provided outside, for example, and exchanges heat between outdoor air and the refrigerant.

The outdoor fan 8, which is provided outside, for example, sends outdoor air to the outdoor heat exchanger 5, and has a fan motor 8*a* and an impeller 8*b*. The fan motor 8*a* is driven to rotate by a command voltage received from the controller 10, and is, for example, a direct-current (DC) fan motor that is driven by a direct current. The impeller 8*b* is rotated when the fan motor 8*a* is driven and rotated, thereby sending outdoor air to the outdoor heat exchanger 5. Note that a Hall IC (not shown) that turns a detected location into a pulse and sends the pulse to the controller 10 is provided on the fan motor 8*a*.

The expansion unit 6 reduces the pressure of the refrigerant to expand the refrigerant, and is, for example, a solenoid expansion valve the opening degree of which is adjusted. The indoor heat exchanger 7 is provided inside of a room, for example, and exchanges heat between indoor air and the refrigerant. Note that the flow switching unit 4 may be omitted. In such a case, for example, a heater or another device is provided near the outdoor heat exchanger 5, and defrosting is performed by using the heater or the other device when frost becomes attached to the outdoor heat exchanger 5 during a heating operation. Furthermore, an indoor fan that sends indoor air to the indoor heat exchanger 7 may be provided.

Figure 2:
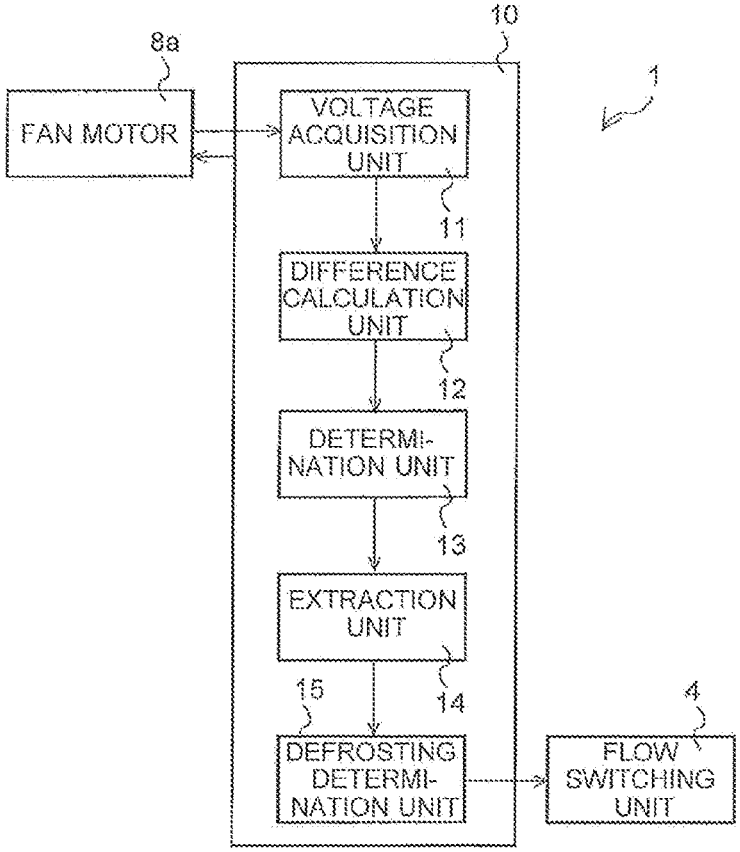
FIG. 2 is a block diagram illustrating a controller 10 of the air-conditioning apparatus 1 according to Embodiment 1 of the present invention.

FIG. 2 is a block diagram illustrating the controller 10 of the air-conditioning apparatus 1 according to Embodiment 1 of the present invention. The following is an explanation of the controller 10. The controller 10 controls the operations of the outdoor fan 8, and is connected to, for example, the fan motor 8*a* of the outdoor fan 8 as shown in FIG. 1. In Embodiment 1, the controller 10 controls the fan motor 8*a* so that the rotation speed of the outdoor fan 8 becomes a predetermined value. The controller 10 calculates the rotation speed of the outdoor fan 8 on the basis of the pulses that have been transmitted from the Hall IC provided on the fan motor 8*a*, and performs feedback control to determine a command voltage to be transmitted to the fan motor 8*a*. As shown in FIG. 2, the controller 10 has a voltage acquisition unit 11, a difference calculation unit 12, a determination unit 13, an extraction unit 14, and a defrosting determination unit 15.

Figure 3:
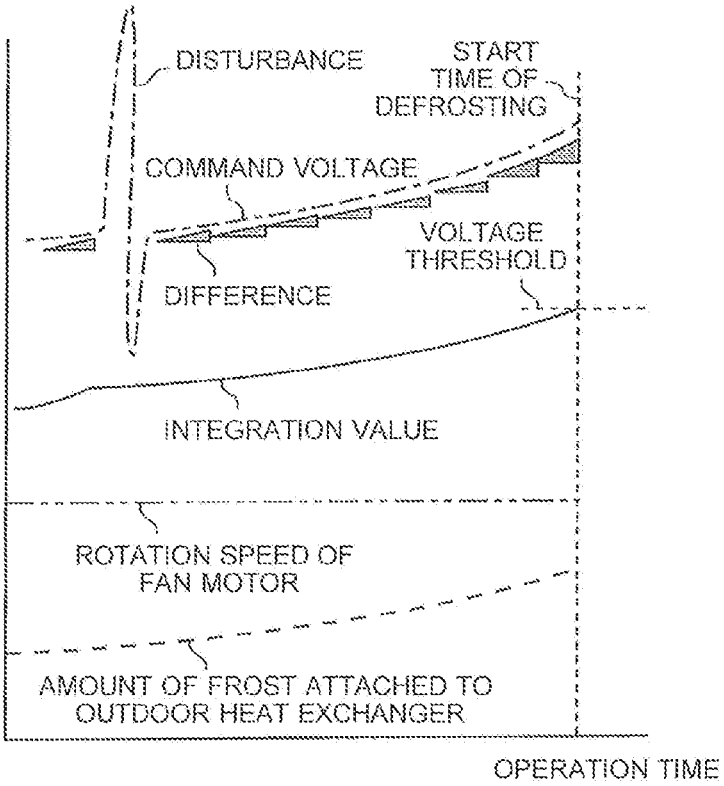
FIG. 3 is a graph illustrating the relationship between a frosting amount and a command voltage of the air-conditioning apparatus 1 according to Embodiment 1 of the present invention.

FIG. 3 is a graph illustrating the relationship between a frosting amount and a command voltage of the air-conditioning apparatus 1 according to Embodiment 1 of the present invention. When frost is attached to the outdoor heat exchanger 5, the resistance of air passing through the outdoor heat exchanger 5 increases. Consequently, to maintain the rotation speed of the outdoor fan 8 constant, the output torque required for the fan motor 8*a* increases. Therefore, the drive voltage of the outdoor fan 8 increases. In Embodiment 1, as shown in FIG. 3, the rotation speed of the outdoor fan 8 is controlled to maintain a predetermined value (long dashed double-short dashed line of FIG. 3). Thus, as the amount of frost attached to the outdoor heat exchanger 5 increases (dashed line of FIG. 3), the command voltage to be transmitted to the fan motor 8*a* increases (long dashed short dashed line of FIG. 3).

The voltage acquisition unit 11 acquires the drive voltage of the outdoor fan 8 at set time intervals while the rotation speed of the outdoor fan 8 is maintained at a reference rotation speed. In Embodiment 1, the voltage acquisition unit 11 acquires command voltages transmitted to the fan motor 8*a* of the outdoor fan 8. In this case, the set time interval is 30 seconds. For example, a voltage detection sensor or another device may be provided to detect a voltage applied to the fan motor 8*a*. In such a case, the voltage acquisition unit 11 acquires voltages detected by the voltage detection sensor or the other device.

The difference calculation unit 12 obtains a difference by subtracting the drive voltage that has been previously acquired by the voltage acquisition unit 11 from the drive voltage acquired by the voltage acquisition unit 11. In Embodiment 1, as shown in FIG. 3, the difference calculation unit 12 obtains a difference by subtracting the command voltage previously acquired by the voltage acquisition unit 11 from the command voltage acquired by the voltage acquisition unit 11.

The determination unit 13 determines whether or not the drive voltage acquired by the voltage acquisition unit 11 is equal to or greater than a lower limit threshold and less than an upper limit threshold. In Embodiment 1, the determination unit 13 determines whether or not the difference obtained by the difference calculation unit 12 is equal to or greater than a lower limit threshold and less than an upper limit threshold. There is a case where the rotation speed of the outdoor fan 8 decreases temporarily due to a disturbance such as a gusty headwind, and thereby a command voltage decreases. In addition, there is a case where the rotation speed of the outdoor fan 8 increases temporarily due to a disturbance such as a gusty tailwind, and thereby a command voltage increases.

The lower limit threshold is set as a lower limit allowed in a case where a command voltage decreases. The upper limit threshold is set as an upper limit allowed in a case where a command voltage increases. That is, the difference that is determined by the determination unit 13 to be equal to or greater than the lower limit threshold and less than the upper limit threshold is determined to be a difference that was obtained when a possibility of occurrence of a disturbance was low. In addition, the difference that is determined by the determination unit 13 to be less than the lower limit threshold or equal to or greater than the upper limit threshold is determined to be a difference that was obtained when there was a possibility of occurrence of a disturbance.

The extraction unit 14 extracts drive voltages that have been determined by the determination unit 13 to be equal to or greater than the lower limit threshold and less than the upper limit threshold to calculate an evaluation value. In Embodiment 1, as shown in FIG. 3, the extraction unit 14 extracts differences that have been determined by the determination unit 13 to be equal to or greater than the lower limit threshold and less than the upper limit threshold, and integrates the differences. That is, the extraction unit 14 excludes differences that have been determined by the determination unit 13 to be less than the lower limit threshold or equal to or greater than the upper limit threshold, and extracts only differences that have been determined by the determination unit 13 to be equal to or greater than the lower limit threshold and less than the upper limit threshold. As described above, in Embodiment 1, differences are used as an evaluation value.

Specifically, the extraction unit 14 regards a difference that has been determined by the determination unit 13 to be less than the lower limit threshold or equal to or greater than the upper limit threshold as zero. Consequently, differences obtained when there was a possibility of occurrence of a disturbance are excluded, and only differences obtained when a possibility of occurrence of a disturbance was low are extracted. Then, the extraction unit 14 integrates extracted differences. That is, the extraction unit 14 does not integrate differences obtained when there was a possibility of occurrence of a disturbance, and integrates only differences obtained when a possibility of occurrence of a disturbance was low.

The defrosting determination unit 15 decides to defrost the outdoor heat exchanger 5 if the evaluation value calculated by the extraction unit 14 is equal to or greater than an evaluation threshold. In Embodiment 1, as shown in FIG. 3, the defrosting determination unit 15 decides to defrost the outdoor heat exchanger 5 if the integration value integrated by the extraction unit 14 is equal to or greater than the evaluation threshold. The integration value extracted and integrated by the extraction unit 14 is obtained by integrating only differences obtained when a possibility of occurrence of a disturbance was low. In Embodiment 1, the defrosting determination unit 15 controls the flow switching unit 4 to defrost the outdoor heat exchanger 5. Consequently, a defrosting operation is started. Note that the defrosting determination unit 15 may perform control so that defrosting is performed not only by a defrosting operation but also by using a heater or other devices.

Next, the operation modes of the air-conditioning apparatus 1 will be described. As operation modes, the air-conditioning apparatus 1 has a cooling operation, a heating operation and a defrosting operation. In the cooling operation, refrigerant flows through the compressor 3, the flow switching unit 4, the outdoor heat exchanger 5, the expansion unit 6, and the indoor heat exchanger 7 in this order and, at the indoor heat exchanger 7, indoor air exchanges heat with the refrigerant, thereby being cooled. In the heating operation, refrigerant flows through the compressor 3, the flow switching unit 4, the indoor heat exchanger 7, the expansion unit 6 and the outdoor heat exchanger 5 in this order and, at the indoor heat exchanger 7, indoor air exchanges heat with the refrigerant, thereby being heated. In the defrosting operation, refrigerant flows through the compressor 3, the flow switching unit 4, the outdoor heat exchanger 5, the expansion unit 6, and the indoor heat exchanger 7 in this order to remove the frost attached to the outdoor heat exchanger 5.

Next, operation of each operation mode of the air-conditioning apparatus 1 will be described. First, the cooling operation is described. In the cooling operation, the refrigerant sucked into the compressor 3 is compressed by the compressor 3 and discharged therefrom in a high-temperature high-pressure gas state. The refrigerant in a high-temperature high-pressure gas state discharged from the compressor 3 passes through the flow switching unit 4, flows into the outdoor heat exchanger 5, and, at the outdoor heat exchanger 5, exchanges heat with outdoor air, thereby being condensed and liquefied. The refrigerant in a condensed liquid state flows into the expansion unit 6, and, at the expansion unit 6, is expanded and the pressure thereof is reduced thereby entering a two-phase gas-liquid state. Then, the refrigerant in a two-phase gas-liquid state flows into the indoor heat exchanger 7 and, at the indoor heat exchanger 7, exchanges heat with the indoor air, thereby being evaporated and gasified. At that moment, the indoor air is cooled and thus the cooling operation is performed. The refrigerant in an evaporated gas state passes through the flow switching unit 4 and is sucked into the compressor 3.

Next, the heating operation is described. In the heating operation, the refrigerant sucked into the compressor 3 is compressed by the compressor 3 and discharged therefrom in a high-temperature high-pressure gas state. The refrigerant in a high-temperature high-pressure gas state discharged from the compressor 3 passes through the flow switching unit 4, flows into the indoor heat exchanger 7, and, at the indoor heat exchanger 7, exchanges heat with the indoor air, thereby being condensed and liquefied. At that moment, the indoor air is heated and thus the heating operation is performed. The refrigerant in a condensed liquid state flows into the expansion unit 6, and, at the expansion unit 6, is expanded and the pressure thereof is reduced thereby entering a two-phase gas-liquid state. Then, the refrigerant in a two-phase gas-liquid state flows into the outdoor heat exchanger 5 and, at the outdoor heat exchanger 5, exchanges heat with outdoor air, thereby being evaporated and gasified. The refrigerant in an evaporated gas state passes through the flow switching unit 4 and is sucked into the compressor 3.

Next, the defrosting operation is described. When the air-conditioning apparatus 1 performs a heating operation, frost may become attached to the outdoor heat exchanger 5. A defrosting operation is performed to remove such frost. In the defrosting operation, the refrigerant sucked into the compressor 3 is compressed by the compressor 3 and discharged therefrom in a high-temperature high-pressure gas state. The refrigerant in a high-temperature high-pressure gas state discharged from the compressor 3 passes through the flow switching unit 4, and flows into the outdoor heat exchanger 5 to melt the frost attached to the outdoor heat exchanger 5. Then, at the outdoor heat exchanger 5, the refrigerant exchanges heat with outdoor air, thereby being condensed and liquefied. The refrigerant in a condensed liquid state flows into the expansion unit 6. In this case, the expansion unit 6 is full opened, and the refrigerant remaining in a liquid state flows into the indoor heat exchanger 7. Then, the refrigerant in a liquid state flows into the indoor heat exchanger 7 and, at the indoor heat exchanger 7, exchanges heat with the indoor air, thereby being evaporated and gasified. The refrigerant in an evaporated gas state passes through the flow switching unit 4 and is sucked into the compressor 3.

Figure 4:
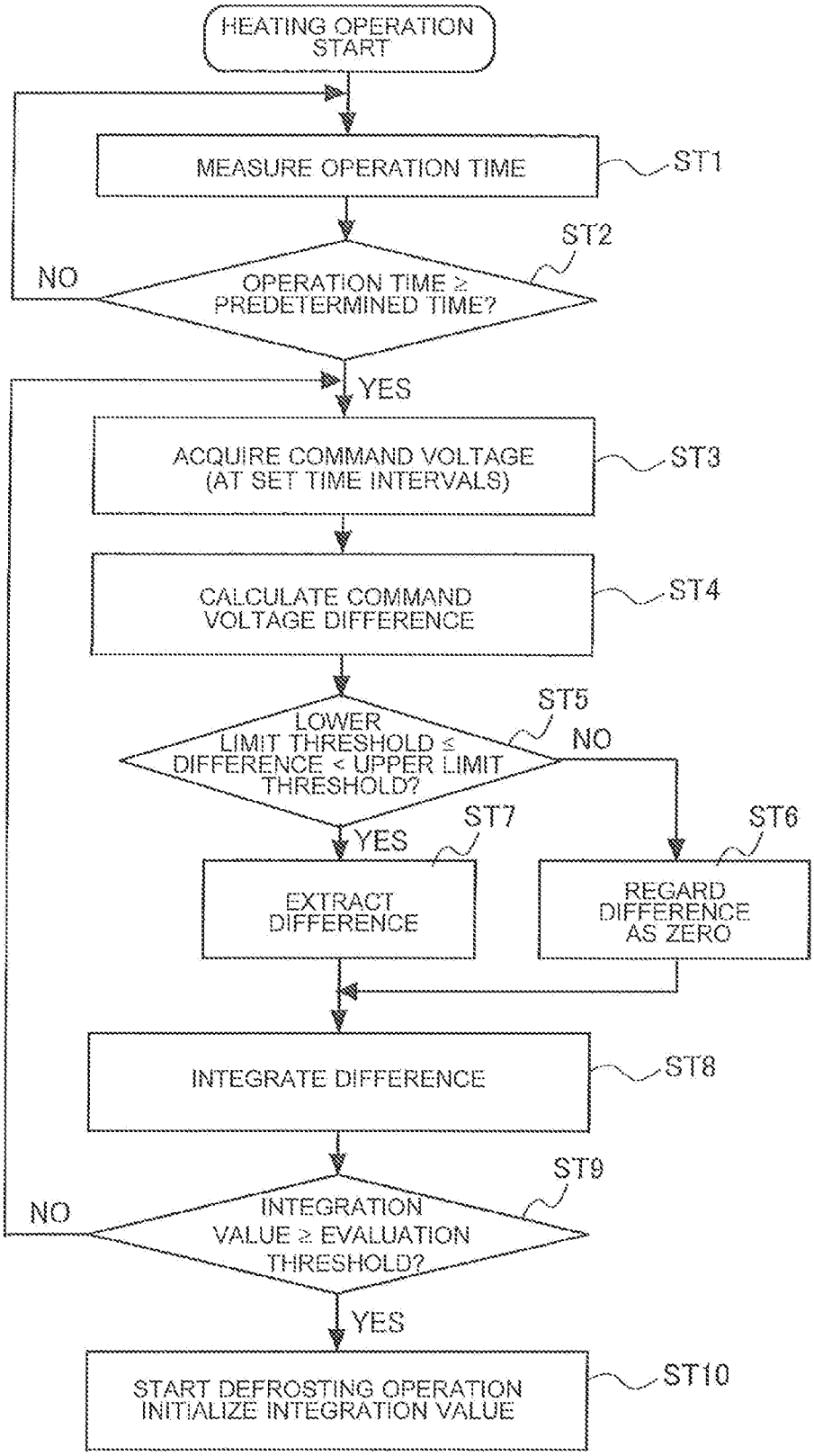
FIG. 4 is a flowchart illustrating operations of the air-conditioning apparatus 1 according to Embodiment 1 of the present invention.

FIG. 4 is a flowchart illustrating operations of the air-conditioning apparatus 1 according to Embodiment 1 of the present invention. The operations of the controller 10 of the air-conditioning apparatus 1 according to Embodiment 1 of the present invention will be described below. As shown in FIG. 4, when a heating operation is started, the time period in which the heating operation is performed is measured (step ST1). Then, it is determined whether or not the measured time period is equal to or greater than a predetermined time period (step ST2). In this case, the predetermined time period is three minutes, for example. If the measured time period is less than the predetermined time period (NO in step ST2), the process returns to step ST1.

Meanwhile, if the measured time period is equal to or greater than the predetermined time period (YES in step ST2), that is, if the predetermined time period has passed since the heating operation was started, the voltage acquisition unit 11 acquires command voltages, which are transmitted to the fan motor 8*a*, at set time intervals while the rotation speed of the outdoor fan 8 is maintained at a reference rotation speed (step ST3). As described above, a predetermined time period has passed since the compressor 3 was activated, therefore, command voltages to be transmitted to the fan motor 8*a* are stabilized. Note that the first acquired command voltage after the heating operation is started is an initial command voltage.

Next, the difference calculation unit 12 obtains a difference by subtracting the command voltage previously acquired by the voltage acquisition unit 11 from the command voltage acquired by the voltage acquisition unit 11 (step ST4). Note that, immediately after the heating operation is started, there is no command voltage acquired before a time threshold, and thus the initial value itself is calculated as a difference. Then, the determination unit 13 determines whether or not the difference obtained by the difference calculation unit 12 is equal to or greater than the lower limit threshold and less than the upper limit threshold (step ST5).

If the difference is determined to be less than the lower limit threshold or equal to or greater than the upper limit threshold (NO in step ST5), the extraction unit 14 does not extract the difference, and regards the difference as zero (step ST6). Meanwhile, if the difference is determined to be equal to or greater than the lower limit threshold and less than the upper limit threshold (YES in step ST5), the extraction unit 14 extracts the difference (step ST7). Then, the extraction unit 14 integrates the difference determined to be equal to or greater than the lower limit threshold and less than the upper limit threshold (step ST8).

Then, the defrosting determination unit 15 determines whether or not the integration value integrated by the extraction unit 14 is equal to or greater than an evaluation threshold (step ST9). If the integration value is less than the evaluation threshold (NO in step ST9), the process returns to step ST3. Meanwhile, if the integration value is equal to or greater than the evaluation threshold (YES in step ST9), the defrosting determination unit 15 decides to defrost the outdoor heat exchanger 5. Then, a defrosting operation is started, and the integration value is initialized (step ST10).

According to Embodiment 1, if the evaluation value, which is calculated by extracting drive voltages determined by the determination unit 13 to be equal to or greater than the lower limit threshold and less than the upper limit threshold, is equal to or greater than the evaluation threshold, the outdoor heat exchanger 5 is defrosted. That is, the necessity of defrosting is determined after excluding the drive voltages that are less than the lower limit threshold or equal to or greater than the upper limit threshold due to occurrences of a disturbance, such as a gusty wind. Therefore, the necessity of defrosting can be determined after sufficiently eliminating the influence of the disturbance.

Conventionally, an air-conditioning apparatus that starts a defrosting operation on the basis of a reduction in the rotation speed of an outdoor fan by a predetermined value is known. When frost is attached to an outdoor heat exchanger, the resistance of air passing through the outdoor heat exchanger increases. In the air-conditioning apparatus that is controlled to reduce the rotation speed of the outdoor fan corresponding to a decrease in the amount of outdoor air that the outdoor fan sends, the rotation speed of the outdoor fan is reduced and the amount of air passing through the outdoor heat exchanger is reduced, and thereby the saturation temperature of the outdoor heat exchanger is further lowered, Consequently, the amount of frost attached to the indoor heat exchanger is further increased, and thereby the heat exchange performance is lowered. Therefore, the coefficient of performance of a refrigeration cycle of the air-conditioning apparatus is lowered. On the other hand, in Embodiment 1, a heating operation is performed while the rotation speed of the outdoor fan 8 is maintained at a reference rotation speed. Therefore, defrosting can be performed in a condition where the coefficient of performance from a heating operation to the start of a defrosting operation reaches the maximum efficient point. Thus, an increase in the power consumption can be suppressed while the performance of the heating operation is maintained.

In addition, an air-conditioning apparatus that starts a defrosting operation on the basis of a reduction in the temperature of an outdoor heat exchanger is known. However, if a temperature detection sensor or another sensor that detects the temperature of the outdoor heat exchanger is frozen, a correct temperature cannot be measured, and thus it is possible that the necessity of a defrosting operation cannot be determined. On the other hand, in Embodiment 1, the necessity of defrosting can be determined without using a temperature detection sensor or another sensor.

In addition, the controller 10 further has the difference calculation unit 12 that obtains a difference by subtracting the drive voltage previously acquired by the voltage acquisition unit 11 from the drive voltage acquired by the voltage acquisition unit 11, the determination unit 13 determines whether or not the difference obtained by the difference calculation unit 12 is equal to or greater than the lower limit threshold and less than the upper limit threshold, the extraction unit 14 extracts a difference determined, by the determination unit 13, to be equal to or greater than the lower limit threshold and less than the upper limit threshold and integrates the difference, and the defrosting determination unit 15 decides to defrost the outdoor heat exchanger 5 if an integration value integrated by the extraction unit 14 is equal to or greater than an evaluation threshold.

As described above, the necessity of defrosting is determined on the basis of the differences that are very small changes in the drive voltage. In this case, the integration value extracted and integrated by the extraction unit 14 is obtained by integrating only differences obtained when a possibility of occurrence of a disturbance was low. Therefore, the necessity of defrosting can be determined after sufficiently eliminating the influence of a disturbance, such as a gusty wind. Furthermore, the necessity of defrosting is determined on the basis of the differences that are very small changes in the drive voltage, and thus, in addition to a gusty wind, the influence of environmental factors, such as dust on the outdoor heat exchanger 5 and deterioration of the outdoor fan 8, can be also suppressed.

The outdoor fan 8 has the fan motor 8*a* configured to be driven to rotate by a command voltage received from the controller 10 and the impeller 8*b* configured to rotate by driving the fan motor 8*a* to rotate, and the voltage acquisition unit 11 acquires the command voltage transmitted to the fan motor 8*a*. Therefore, a voltage detection sensor or another sensor is not required to obtain a drive voltage. Thus, the cost can be reduced.

The flow switching unit 4 configured to switch the direction of refrigerant flow in the refrigerant circuit 2 is further provided, and the defrosting determination unit 15 controls the flow switching unit 4 to defrost the outdoor heat exchanger 5. Thus, when the defrosting determination unit 15 decides to defrost the outdoor heat exchanger 5, a defrosting operation is performed.

Note that, in Embodiment 1, the necessity of defrosting is determined on the basis of the calculation of the drive voltage differences, however, the necessity of defrosting may be determined on the basis of the calculation of the average drive voltage. That is, the average value may be used as the evaluation value. In this case too, the influence of a disturbance, such as a gusty wind, can be suppressed.

Embodiment 2

Figure 5:
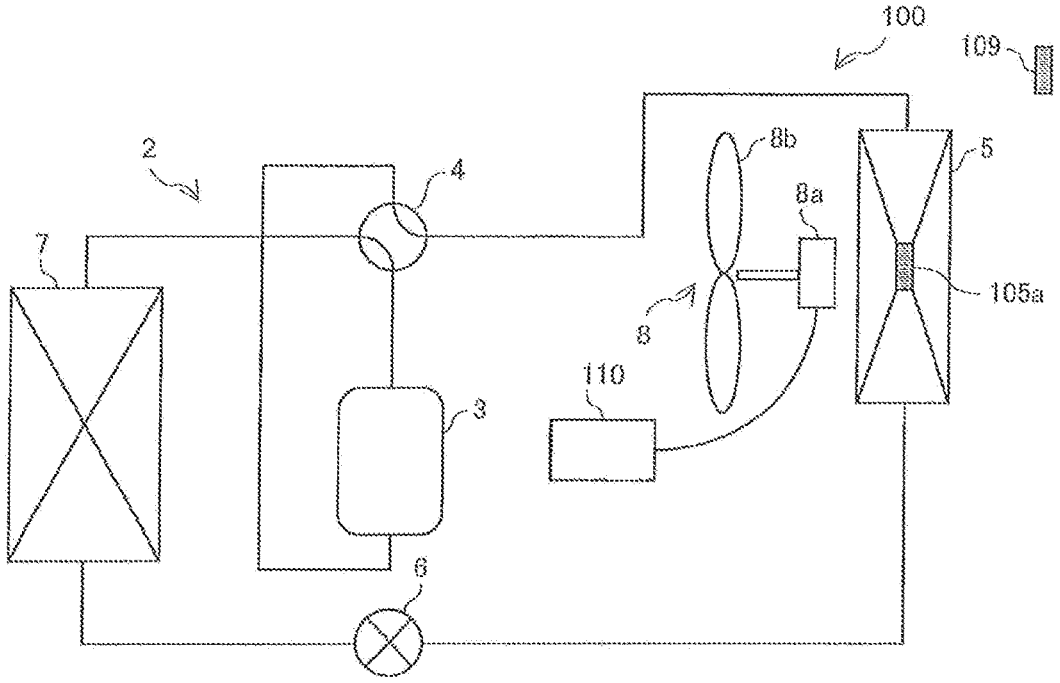
FIG. 5 is a circuit diagram illustrating an air-conditioning apparatus 100 according to Embodiment 2 of the present invention.

FIG. 5 is a circuit diagram illustrating an air-conditioning apparatus 100 according to Embodiment 2 of the present invention. Embodiment 2 differs from Embodiment 1 in that Embodiment 2 includes an outdoor temperature detection unit 109 and an outdoor heat exchanger temperature detection unit 105*a*. In Embodiment 2, the same features as Embodiment 1 are denoted by the same signs and the explanations thereof are omitted, and the differences from Embodiment 1 are mainly explained.

As shown in FIG. 5, the outdoor temperature detection unit 109 is provided outside, for example, and detects the temperature of outdoor air. The outdoor heat exchanger temperature detection unit 105*a* is provided, for example, on a pipe connected to the outdoor heat exchanger 5, and detects the temperature of the refrigerant flowing in the outdoor heat exchanger 5.

Figure 6:
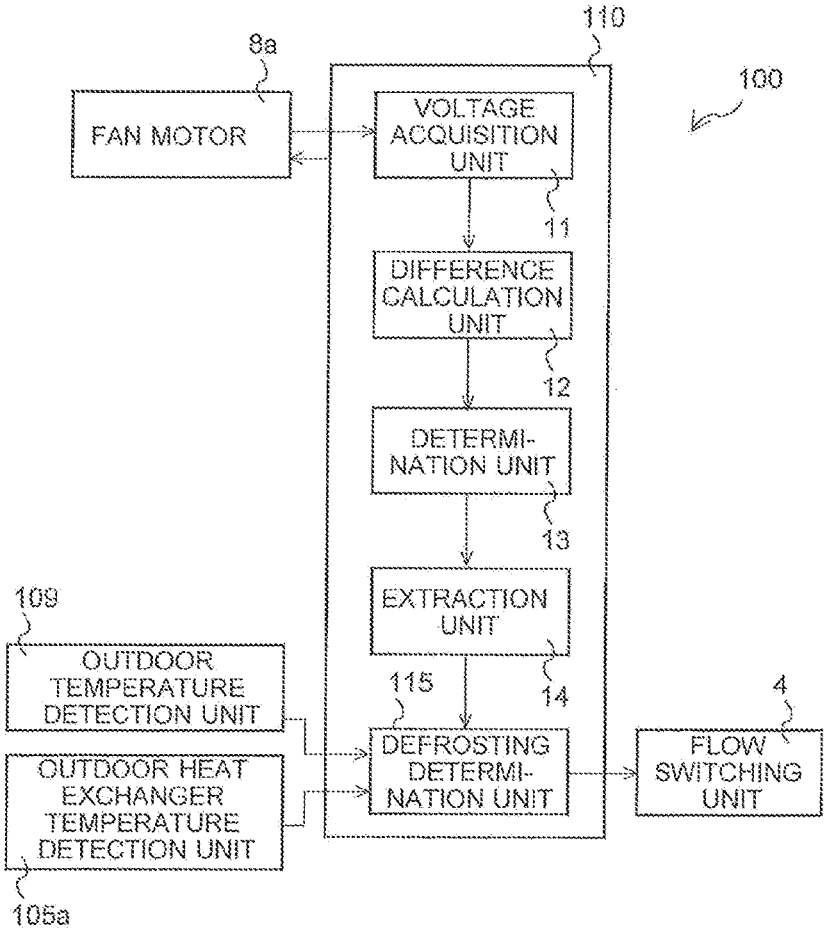
FIG. 6 is a block diagram illustrating a controller 110 of the air-conditioning apparatus 100 according to Embodiment 2 of the present invention.

FIG. 6 is a block diagram illustrating a controller 110 of the air-conditioning apparatus 100 according to Embodiment 2 of the present invention. As shown in FIG. 6, the defrosting determination unit 115 decides to defrost the outdoor heat exchanger 5 if the evaluation value calculated by the extraction unit 14 is equal to or greater than the evaluation threshold and if the temperature detected by the outdoor temperature detection unit 109 is equal to or less than an outdoor temperature threshold. If the temperature of outdoor air is high, frost is not likely to become attached to the outdoor heat exchanger 5 and, therefore, it is determined that defrosting is not required. On the other hand, if the temperature of outdoor air is low, frost is likely to become attached to the outdoor heat exchanger 5 and, therefore, it is determined that defrosting is required. In such a manner, in Embodiment 2, the necessity of defrosting is determined on the basis of the temperature of outdoor air, in addition to the evaluation value calculated by the extraction unit 14. An outdoor temperature threshold is zero degrees C., for example.

In addition, the defrosting determination unit 115 decides to defrost the outdoor heat exchanger 5 if the evaluation value calculated by the extraction unit 14 is equal to or greater than the evaluation threshold and if the temperature detected by the outdoor heat exchanger temperature detection unit 105*a* is equal to or less than an outdoor heat exchanger temperature threshold. In a heating operation, if the temperature of the refrigerant flowing in the outdoor heat exchanger 5, which functions as an evaporator, is high, it is determined that the heat exchange performance is maintained and, therefore, it is determined that defrosting is not required. On the other hand, in a heating operation, if the temperature of the refrigerant flowing in the outdoor heat exchanger 5, which functions as an evaporator, is low, it is determined that the heat exchange performance is lowered and, therefore, it is determined that defrosting is required. In such a manner, in Embodiment 2, the necessity of defrosting is determined on the basis of the temperature of the refrigerant flowing in the outdoor heat exchanger 5, in addition to the evaluation value calculated by the extraction unit 14. An outdoor heat exchanger temperature threshold is zero degrees C., for example.

Furthermore, the defrosting determination unit 115 decides to defrost the outdoor heat exchanger 5 if the evaluation value calculated by the extraction unit 14 is equal to or greater than the evaluation threshold and if a time period in which a heating operation is performed is equal to or greater than a heating time threshold. As time elapses since the start of a heating operation, frost is likely to become attached to the outdoor heat exchanger 5. Therefore, in Embodiment 2, the necessity of defrosting is determined on the basis of the time period in which a heating operation is performed, in addition to the evaluation value calculated by the extraction unit 14. Note that a time period in which a heating operation is performed may be used in a case where the temperature cannot be detected by the outdoor temperature detection unit 109 or the outdoor heat exchanger temperature detection unit 105*a* due to freezing or other reasons.

Figure 7:
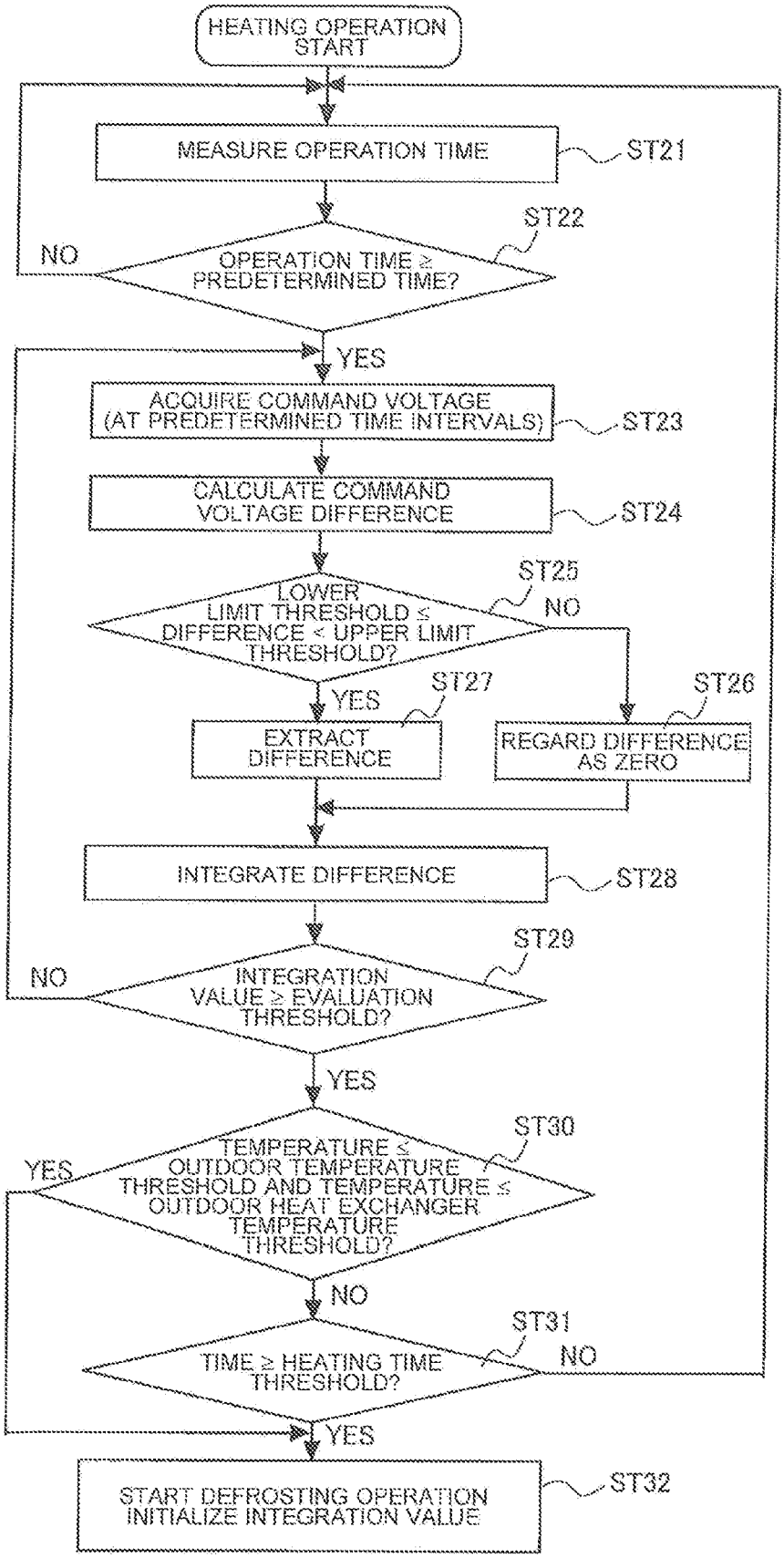
FIG. 7 is a flowchart illustrating operations of the air-conditioning apparatus 100 according to Embodiment 2 of the present invention.

FIG. 7 is a flowchart illustrating operations of the air-conditioning apparatus 100 according to Embodiment 2 of the present invention. As shown in FIG. 7, the operations of the controller 110 of the air-conditioning apparatus 100 according to Embodiment 2 of the present invention will be described below. As shown in FIG. 7, when a heating operation is started, the time period in which the heating operation is performed is measured (step ST21). Then, it is determined whether or not the measured time period is equal to or greater than a predetermined time period (step ST22). In this case, the predetermined time period is three minutes, for example. If the measured time period is less than the predetermined time period (NO in step ST22), the process returns to step ST21.

Meanwhile, if the measured time period is equal to or greater than the predetermined time period (YES in step ST22), that is, if the predetermined time period has passed since the heating operation was started, the voltage acquisition unit 11 acquires command voltages, which are transmitted to the fan motor 8*a*, at set time intervals while the rotation speed of the outdoor fan 8 is maintained at a reference rotation speed (step ST23). As described above, because a predetermined time period has passed since the compressor 3 was activated, command voltages to be transmitted to the fan motor 8*a* are stabilized. Note that the first acquired command voltage after the heating operation is started is an initial command voltage.

Next, the difference calculation unit 12 obtains a difference by subtracting the command voltage previously acquired by the voltage acquisition unit 11 from the command voltage acquired by the voltage acquisition unit 11 (step ST24). Note that, immediately after the heating operation is started, there is no command voltage acquired before a time threshold, and thus the initial value itself is calculated as a difference. Then, the determination unit 13 determines whether or not the difference obtained by the difference calculation unit 12 is equal to or greater than the lower limit threshold and less than the upper limit threshold (step ST25).

If the difference is determined to be less than the lower limit threshold or equal to or greater than the upper limit threshold (NO in step ST25), the extraction unit 14 does not extract the difference, and regards the difference as zero (step ST26). Meanwhile, if the difference is determined to be equal to or greater than the lower limit threshold and less than the upper limit threshold (YES in step ST25), the extraction unit 14 extracts the difference (step ST27). Then, the extraction unit 14 integrates the difference determined to be equal to or greater than the lower limit threshold and less than the upper limit threshold (step ST28). Then, the defrosting determination unit 15 determines whether or not the integration value integrated by the extraction unit 14 is equal to or greater than an evaluation threshold (step ST29). If the integration value is less than the evaluation threshold (NO in step ST29), the process returns to step ST23.

Meanwhile, if the integration value is equal to or greater than the evaluation threshold (YES in step ST29), the defrosting determination unit 115 determines whether or not the temperature detected by the outdoor temperature detection unit 109 is equal to or less than the outdoor temperature threshold and whether or not the temperature detected by the outdoor heat exchanger temperature detection unit 105*a* is equal to or less than the outdoor heat exchanger temperature threshold (step ST30). If it is determined that the temperature detected by the outdoor temperature detection unit 109 is equal to or less than the outdoor temperature threshold and the temperature detected by the outdoor heat exchanger temperature detection unit 105*a* is equal to or less than the outdoor heat exchanger temperature threshold (YES in step ST30), defrosting of the outdoor heat exchanger 5 is decided. Then, a defrosting operation is started, and the integration value is initialized (step ST32).

On the other hand, if it is determined that the temperature detected by the outdoor temperature detection unit 109 is greater than the outdoor temperature threshold or the temperature detected by the outdoor heat exchanger temperature detection unit 105*a* is greater than the outdoor heat exchanger temperature threshold (NO in step ST30), the defrosting determination unit 115 determines whether or not the time period in which the heating operation is performed is equal to or greater than the heating time threshold (step ST31). If it is determined that the time period in which the heating operation is performed is less than the heating time threshold (NO in step ST31), the process returns to step ST21. If the time period in which the heating operation is performed is equal to or greater than the heating time threshold (YES in step ST31), defrosting of the outdoor heat exchanger 5 is decided. Then, a defrosting operation is started, and the integration value is initialized (step ST32).

According to Embodiment 2, the necessity of defrosting is determined on the basis of, in addition to the evaluation value calculated by the extraction unit 14, the temperature of outdoor air, the temperature of the refrigerant flowing in the outdoor heat exchanger 5, and the time period in which a heating operation is performed. Therefore, the necessity of defrosting can be determined after eliminating the influence of disturbances.

The outdoor temperature detection unit 109 configured to detect the temperature of outdoor air is further provided, and the defrosting determination unit 115 decides to defrost the outdoor heat exchanger 5 if the evaluation value calculated by the extraction unit 14 is equal to or greater than the evaluation value threshold and if the temperature detected by the outdoor temperature detection unit 109 is equal to or less than the outdoor temperature threshold. If the temperature of outdoor air is low, frost is likely to become attached to the outdoor heat exchanger 5 and, therefore, it is determined that defrosting is required. In Embodiment 2, the necessity of defrosting is determined on the basis of the temperature of outdoor air, in addition to the evaluation value calculated by the extraction unit 14, and thus, the accuracy in the determination of the necessity of defrosting is further improved.

Moreover, the outdoor heat exchanger temperature detection unit 105*a* configured to detect the temperature of the refrigerant flowing in the outdoor heat exchanger 5 is further provided, and the defrosting determination unit 115 decides to defrost the outdoor heat exchanger 5 if the evaluation value calculated by the extraction unit 14 is equal to or greater than the evaluation value threshold and if the temperature detected by the outdoor heat exchanger temperature detection unit 105*a* is equal to or less than the outdoor heat exchanger temperature threshold. In a heating operation, if the temperature of the refrigerant flowing in the outdoor heat exchanger 5, which functions as an evaporator, is low, it is determined that the heat exchange performance is lowered and, therefore, it is determined that defrosting is required. In Embodiment 2, the necessity of defrosting is determined on the basis of the temperature of the refrigerant flowing in the outdoor heat exchanger 5, in addition to the evaluation value calculated by the extraction unit 14, and thus, the accuracy in the determination of the necessity of defrosting is further improved.

Furthermore, the defrosting determination unit 115 decides to defrost the outdoor heat exchanger 5 if the evaluation value calculated by the extraction unit 14 is equal to or greater than the evaluation value threshold and if the time period in which the heating operation is performed is equal to or greater than the heating time threshold. As time elapses since the start of a heating operation, frost is likely to become attached to the outdoor heat exchanger 5. In Embodiment 2, the necessity of defrosting is determined on the basis of the time period in which a heating operation is performed, in addition to the evaluation value calculated by the extraction unit 14, and thus, the accuracy in the determination of the necessity of defrosting is further improved.

Note that determination of the necessity of defrosting on the basis of the temperature of outdoor air, determination of the necessity of defrosting on the basis of the temperature of the refrigerant flowing in the outdoor heat exchanger 5, and the determination of the necessity of defrosting on the basis of the time period in which a heating operation is performed may be performed independently.

REFERENCE SIGNS LIST

1 air-conditioning apparatus 2 refrigerant circuit 3 compressor 4 flow switching unit 5 outdoor heat exchanger 6 expansion unit 7 indoor heat exchanger 8 outdoor fan 8*a* fan motor 8*b* impeller 10 controller 11 voltage acquisition unit 12 difference calculation unit 13 determination unit 14 extraction unit 15 defrosting determination unit 100 air-conditioning apparatus 105*a* outdoor heat exchanger temperature detection unit 109 outdoor temperature detection unit 110 controller 115 defrosting determination unit

The invention claimed is:

1. An air-conditioning apparatus comprising:

a compressor, an outdoor heat exchanger, an expansion valve and an indoor heat exchanger connected, by pipes, in a refrigerant circuit through which refrigerant flows;

an outdoor fan configured to send outdoor air to the outdoor heat exchanger; and a controller configured to control operations of the outdoor fan, wherein the controller is configured to acquire drive voltages of the outdoor fan at set time intervals while a rotation speed of the outdoor fan is maintained at a reference rotation speed, obtain a difference by subtracting a drive voltage previously acquired by the controller from a drive voltage acquired by the controller, determine whether or not the difference acquired by the controller is equal to or greater than a lower limit threshold and less than an upper limit threshold, calculate an evaluation value by extracting the difference determined, by the controller, to be equal to or greater than the lower limit threshold and less than the upper limit threshold, integrate the difference extracted by the controller, and defrost the outdoor heat exchanger when, as the evaluation value, an integration value integrated by the controller is equal to or greater than an evaluation threshold.

2. The air-conditioning apparatus of claim 1, wherein the outdoor fan has a fan motor configured to be driven to rotate by a command voltage received from the controller and an impeller configured to rotate by driving the fan motor to rotate, and wherein the controller is configured to acquire the command voltage transmitted to the fan motor.

3. The air-conditioning apparatus of claim 1, further comprising an outdoor temperature sensor configured to detect a temperature of the outdoor air, wherein the controller is configured to defrost the outdoor heat exchanger when the evaluation value calculated by the controller is equal to or greater than the evaluation threshold and when the temperature detected by the outdoor temperature sensor is equal to or less than an outdoor temperature threshold.

4. The air-conditioning apparatus of claim 1, further comprising an outdoor heat exchanger temperature sensor configured to detect a temperature of the refrigerant flowing through the outdoor heat exchanger, wherein the controller is configured to defrost the outdoor heat exchanger when the evaluation value calculated by the extraction unit is equal to or greater than the evaluation threshold and when the temperature detected by the outdoor heat exchanger temperature sensor is equal to or less than an outdoor heat exchanger temperature threshold.

5. The air-conditioning apparatus of claim 1, wherein the controller is configured to defrost the outdoor heat exchanger when the evaluation value calculated by the controller is equal to or greater than the evaluation threshold and when a time period in which a heating operation is performed is equal to or greater than a heating time threshold.

6. The air-conditioning apparatus of claim 1, wherein the evaluation value is an average value.

* * * * *